US010702030B2

(12) United States Patent
Gibson et al.

(10) Patent No.: US 10,702,030 B2
(45) Date of Patent: Jul. 7, 2020

(54) WEARABLE FLUORESCENT ARTICLE OF ADORNMENT WITH ULTRAVIOLET RADIATION SOURCE OF EXCITATION

(71) Applicant: Sensor Electronic Technology, Inc., Columbia, SC (US)

(72) Inventors: Carlton Gibson, Columbia, SC (US); Alexander Dobrinsky, Silver Spring, MD (US)

(73) Assignee: Sensor Electronic Technology, Inc., Columbia, SC (US)

( * ) Notice: Subject to any disclaimer, the term of this patent is extended or adjusted under 35 U.S.C. 154(b) by 0 days.

(21) Appl. No.: 16/144,398

(22) Filed: Sep. 27, 2018

(65) Prior Publication Data

US 2019/0098969 A1 Apr. 4, 2019

Related U.S. Application Data

(60) Provisional application No. 62/566,418, filed on Sep. 30, 2017.

(51) Int. Cl.

| | |
|---|---|
| ***A44C 15/00*** | (2006.01) |
| ***F21V 33/00*** | (2006.01) |
| ***F21V 9/32*** | (2018.01) |
| ***F21V 7/30*** | (2018.01) |
| *F21W 121/06* | (2006.01) |
| *F21Y 113/13* | (2016.01) |
| *A44C 9/00* | (2006.01) |
| *F21Y 115/10* | (2016.01) |

(52) U.S. Cl.

CPC ..... *A44C 15/0015* (2013.01); *F21V 7/30* (2018.02); *F21V 9/32* (2018.02); *F21V 33/0008* (2013.01); *A44C 9/0053* (2013.01); *F21W 2121/06* (2013.01); *F21Y 2113/13* (2016.08); *F21Y 2115/10* (2016.08)

(58) Field of Classification Search

CPC ..... A44C 15/0015; A44C 9/0053; F21V 7/30; F21V 9/32; F21V 33/0008; F21Y 2115/10; F21Y 2113/13; F21W 2121/06

See application file for complete search history.

(56) References Cited

U.S. PATENT DOCUMENTS 7,131,743 B2 * 11/2006 Leason ..... A44C 15/0015 362/104
8,911,664 B1 * 12/2014 Cavanaugh ..... A01G 22/00 422/24
9,572,903 B2 2/2017 Dobrinsky et al.

(Continued)

*Primary Examiner* — Tracie Y Green

(74) *Attorney, Agent, or Firm* — LaBatt, LLC

(57) ABSTRACT

A wearable fluorescent article of adornment with ultraviolet radiation source of excitation is described. At least one ultraviolet light emitting source can irradiate a fluorescent material with ultraviolet radiation. The fluorescent material can generate fluorescent light in response to excitation of the fluorescent material with ultraviolet radiation emitted from the at least one ultraviolet light emitting source. The article of adornment can transmit the fluorescent light generated from the fluorescent material while absorbing the ultraviolet radiation. A control unit can control irradiation of the fluorescent material with the at least one ultraviolet light emitting source, while a power supply component can power the at least one ultraviolet light emitting source and/or the control unit.

20 Claims, 7 Drawing Sheets

(56) References Cited

U.S. PATENT DOCUMENTS

| | | | | |
|---|---|---|---|---|
| 10,052,496 | B2 * | 8/2018 | Sauer | A61N 5/0616 |
| 2004/0136179 | A1 * | 7/2004 | Lewis | A44C 15/0015 362/104 |
| 2008/0163646 | A1 * | 7/2008 | Czajka | A44C 9/02 63/15.6 |
| 2012/0212938 | A1 * | 8/2012 | Nguyen | F21V 33/0008 362/104 |
| 2013/0078411 | A1 * | 3/2013 | Gaska | C09D 163/00 428/68 |
| 2015/0062954 | A1 * | 3/2015 | Crossland | D06P 1/0012 362/552 |
| 2015/0075217 | A1 | 3/2015 | Disinger | |
| 2015/0297768 | A1 * | 10/2015 | Bettles | A61L 2/10 250/455.11 |
| 2016/0027970 | A1 * | 1/2016 | Shatalov | H01L 24/97 438/27 |
| 2017/0311553 | A1 | 11/2017 | Dobrinsky et al. | |
| 2018/0117194 | A1 | 5/2018 | Dobrinsky et al. | |
| 2018/0153417 | A1 | 6/2018 | Dobrinsky et al. | |
| 2018/0174389 | A1 | 6/2018 | Dobrinsky et al. | |
| 2018/0353771 | A1 * | 12/2018 | Kim | A61N 5/0616 |
| 2019/0099613 | A1 * | 4/2019 | Estes | A61N 5/0616 |
| 2019/0117992 | A1 * | 4/2019 | Iguchi | A61N 5/06 |

* cited by examiner

WEARABLE FLUORESCENT ARTICLE OF ADORNMENT WITH ULTRAVIOLET RADIATION SOURCE OF EXCITATION

REFERENCE TO RELATED APPLICATIONS

The present patent application claims the benefit of U.S. Provisional Application No. 62/566,418, filed on 30 Sep. 2017, which is hereby incorporated by reference.

TECHNICAL FIELD

The present invention relates generally to light emitting adornments, and more particularly, to a light emitting adornment utilizing an ultraviolet light emitting source to irradiate fluorescent material in order to generate fluorescent light and can include a control unit to control the irradiation of the fluorescent material and the generation of the fluorescent light.

BACKGROUND ART

Light emitting adornments are sometimes used with jewelry, clothing, and decorations in order to enhance, embellish or distinguish the wearer or object in which the adornments are worn or applied. These light emitting adornments often rely on electronic circuitry to emit light due to fluorescent radiation. However, present light emitting adornments used with jewelry, clothing, decorations, and the like, have size limitations due to the circuitry used to generate the fluorescent light. Plus, the degree to which these light emitting adornments can generate appealing qualities of fluorescent light that enhance, embellish or distinguish the wearer or object are also limited.

SUMMARY OF THE INVENTION

This Summary of the Invention introduces a selection of certain concepts in a brief form that are further described below in the Detailed Description of the Invention. It is not intended to exclusively identify key features or essential features of the claimed subject matter set forth in the Claims, nor is it intended as an aid in determining the scope of the claimed subject matter.

Aspects of the present invention are directed to light emitting adornments that utilize an ultraviolet light emitting source to irradiate fluorescent material in order to generate fluorescent light and can include a control unit to control the irradiation of the fluorescent material and the generation of the fluorescent light. In this manner, the light emitting adornments can be configured to generate a multitude of different fluorescent light characteristics and color spectra. To this extent, the light emitting adornments of the various embodiments described herein can generate more appealing qualities of fluorescent light that enhance, embellish or distinguish the wearer or object utilizing the adornments. This makes the light emitting adornments suitable for a variety of articles of adornments that have heretofore been limited to the types of fluorescent light characteristics that can be generated therefrom due to, for example, limitations associated with the circuitry used with these articles to generate the fluorescent light. For example, the light emitting adornments of the various embodiments are applicable as wearable articles of adornment that can be incorporated into an accessory or decoration that is worn, placed, arranged, disposed, etc., on a body of a wearer of the articles or an object that utilizes the articles. Jewelry such as bracelets including ankle bracelets, bands, necklaces, earrings, watches, rings, lapel pins and pendants, body piercings, clothing accessories, and hair accessories are only a few non-exhaustive examples of possible wearable articles of adornment that are suitable for use with any of the embodiments described herein. In a different light, decorations placed, arranged, disposed, etc., on objects such as cell phone cases, toys, fish habitats, paperweights, and writing utensils are only a few non-exhaustive examples of other possible wearable articles of adornment that are commensurate for use with any of the embodiments described herein.

Each of the various embodiments described herein can utilize at least one ultraviolet light emitting source to irradiate fluorescent material in order to generate fluorescent light. An ultraviolet light emitting diode (UV LED) is one type of ultraviolet light emitting source that can be used for the irradiation of the fluorescent material. In particular, the UV LED can operate at a wavelength that ranges from about 250 nanometers (nm) to about 460 nm in order to attain excitation of the fluorescent material that is suitable for generating fluorescent light with desirable fluorescent light characteristics that enhance, embellish or distinguish the wearer or the object that utilizes one of the wearable articles of adornment described herein. In one embodiment, a set of ultraviolet light emitting sources such as UV LEDs can be utilized to irradiate fluorescent material. For example, the set of ultraviolet light emitting sources can be configured to operate at at least two different peak wavelengths, with each different peak wavelength selected from a range of 250 nm to 460 nm. In one embodiment, the set of ultraviolet light emitting sources can operate in a pulsed mode of operation.

One or more optical elements can be used to optically couple the ultraviolet radiation to the fluorescent material. In one embodiment, the optical element(s) can be placed in proximity to the ultraviolet light emitting source(s). The optical element(s) can include, but are not limited to, parabolic mirrors, mirrors, prisms and lenses. In one embodiment, ultraviolet reflective surfaces can be used to recycle the ultraviolet radiation.

The fluorescent material used in the various embodiments can include any of a variety of materials that can generate fluorescent light in response to excitation by the ultraviolet light emitting source(s). In one embodiment, the fluorescent material can comprise a phosphor of different colors. Other fluorescent materials can include, but are not limited to, semiconductor powders and fluorescent dyes. In one embodiment, a fluorescent material that fluoresces at several wavelengths of ultraviolet excitation can comprise a composite material of several phosphors, with each phosphor having emission at its characteristic wavelength.

The ultraviolet light emitting source(s) and the fluorescent material can be placed in a housing having an inner wall surface and an outer wall surface that forms a part of the wearable article of adornment. In one embodiment, the ultraviolet light emitting source(s) and the fluorescent material can be positioned on the inner wall surface of the housing. The ultraviolet light emitting source(s) can be oriented to directly irradiate the fluorescent material. In one embodiment, ultraviolet transparent material with light guiding media can be used to guide the ultraviolet radiation generated from the ultraviolet light emitting source(s) to fluorescent material embedded in the media. In one embodiment, rough elements can be added to the ultraviolet transparent material with light guiding media to create fluorescent diffusive emittance of the fluorescent light generated from the fluorescent material. In one embodiment, the ultraviolet transparent material with light guiding media can have an index of refraction that is at least 10% higher than the index of refraction at an interface with the outer wall surface. In one embodiment, the fluorescent material embedded in the ultraviolet transparent material with light guiding media can comprise internal cavities filled with air or water in order to scatter the fluorescent radiation towards the user.

In one embodiment, the fluorescent material can be deployed as a fluorescent film that is removable from the housing. For example, fluorescent film holders can be used to secure the fluorescent film in a predetermined position separated from the ultraviolet light emitting source(s). To this extent, the fluorescent film can be removed from the article of adornment with or without the film holders and replaced with another. For example, in this manner, fluorescent films that generate a different set of fluorescent light characteristics (e.g., different fluorescent light wavelengths, intensities, patterns and duration) can be easily inserted for use with the article and removed therefrom when the use of another fluorescent film with different characteristics is desired.

In one embodiment, a portion of the inner wall surface containing the fluorescent material can comprise a liquid having a plurality of fluorescent domains floating in the liquid. In one embodiment, the fluorescent domains can comprise nanomaterials such as nanodots, wherein the size of the nanodots can be varied to provide desired color characteristics to the generated fluorescent light. A plurality of ultraviolet scattering domains can also be added to float in the liquid in order to scatter the fluorescent light generated from the fluorescent domains, aiding in obtaining fluorescent light characteristics of a desired effect.

The portion of the inner wall surface containing the fluorescent material can comprise a composite material, wherein at least part of the composite material can fluoresce upon excitation with ultraviolet radiation. In one embodiment, the composite material can comprise a mix of different fluorescent material, each configured to fluoresce light at different fluorescent wavelengths.

The outer wall surface of the housing can include a light transmitting material that is configured to transmit the fluorescent light generated from the fluorescent material while absorbing the ultraviolet radiation generated from the ultraviolet light emitting source(s). In one embodiment, the outer wall surface of the housing can include a window that optically aligns with the fluorescent material on the inner wall surface of the housing in order to transmit the visible light outside of the housing.

In one embodiment, an enclosure can be used to enclose the housing. In this manner, the ultraviolet light emitting source(s) can be placed in the housing, while an inner wall surface of the enclosure can include the fluorescent material. In this embodiment, the fluorescent material can include any of the materials described herein, as well as take the form of any of the configurations described herein. Further, the outer wall of the enclosure can include a window that optically aligns with the fluorescent material on the inner wall surface of the enclosure in order to transmit the visible light outside of the enclosure, and include a material that absorbs the ultraviolet radiation.

The housing and enclosure configuration can be used to form a number of different wearable articles of adornment. For example, the housing and enclosure configuration has application with jewelry type adornments. In one embodiment, the housing and the enclosure can be segmented into corresponding sections. To this extent, each segmented housing section can include an ultraviolet light emitting source with a corresponding enclosure section to enclose the housing section. Each enclosure section can have an inner wall surface including a fluorescent material and an outer wall surface including a light transmitting material to transmit fluorescent light outside the enclosure section while absorbing ultraviolet radiation. In this configuration, each segmented housing section and corresponding enclosure section can generate fluorescent light at a predetermined fluorescent wavelength, intensity and pattern. In one embodiment, each segmented housing section and corresponding enclosure section can operate independently from the other segmented housing and corresponding enclosure sections. For example, each segmented housing section and corresponding segmented enclosure section can operate in a pulsed mode with varying pulse durations and time intervals between pulses, or operate in a non-pulsed mode. All of the segmented housing sections and corresponding enclosure sections can form a distributed system of connected adornment elements, making this embodiment suitable for use as wearable articles of manufacture that can include, but are not limited to, bracelets, bands, watches, necklaces, and rings.

The wearable articles of adornment of the various embodiments can include other radiation sources beside the light emitting source(s). For example, the wearable articles of adornment can include at least one visible light emitting source. This allows the articles of adornment to enhance the generated fluorescent light with other forms of visible light to create a more specialized embellishment effect. Examples of visible light emitting sources that can be used include, but are not limited to, light emitting diodes and devices generating light due to chemiluminescence (e.g., glow stick). In one embodiment, a set of visible light emitting sources can be used in conjunction with the ultraviolet light emitting sources.

The wearable articles of adornment of the various embodiments can further include a control unit configured to control irradiation of the fluorescent material with the ultraviolet light emitting source(s) and any visible light generated from the visible light emitting source(s) if used. For example, the control unit can control the fluorescent light characteristics of the generated fluorescent light such as the fluorescent wavelength, fluorescent intensity, and fluorescent pattern as a function of the ultraviolet radiation generated from the ultraviolet light emitting source(s) that irradiates the fluorescent material. In one embodiment, the control unit can specify various operating parameters for the ultraviolet light emitting source(s) that influence the fluorescent light. The operating parameters can include, but are not limited to, an illumination time that ultraviolet radiation is directed towards the fluorescent material, a dosage of ultraviolet radiation delivered by the ultraviolet light emitting source(s), a power setting for operating the ultraviolet light emitting source(s), and a maximum operating temperature. In one embodiment, the control unit also can use these operating parameters to control a set of ultraviolet light emitting sources and the fluorescent material to operate in a pulsed manner to generate varying pulses of fluorescent light with the option to have the pulses of fluorescent light differ by wavelength, intensity, pattern and duration.

The control unit can include or operate in conjunction with other components to facilitate the generation of the fluorescent light in the wearable articles of adornment of the various embodiments. For example, a timer can be set in accordance with the specified illumination time in order to ensure that the ultraviolet light emitting source(s) delivers a sufficient dosage to obtain the desired effect. A user input component can permit a user to selectively activate and inactivate operation of the ultraviolet light emitting source (s) and/or visible light emitting sources. In this manner, the user can select an operating mode from one of a variety of different modes that are each configured to generate fluorescent light at a predetermined fluorescent wavelength, intensity and pattern.

At least one sensor can be configured to monitor one of the operating parameters during the illumination time, as well as at least one sensor can be configured to monitor the fluorescent characteristics of the generated fluorescent light. The control unit can use the signals from the sensor(s) to control the operation of the ultraviolet light emitting source(s) as well as any other visible light sources that may be used. In one embodiment, a plurality of radiation sensors can be used to detect radiation measurements about the housing and/or the enclosure. Some of these can be used to measure the ultraviolet radiation characteristics of the ultraviolet radiation that irradiates the fluorescent material, while at least one of these sensors can include a fluorescent radiation sensor to measure fluorescent radiation characteristics of the fluorescent light. In one embodiment, a plurality of environmental condition sensors (e.g., temperature sensor, pressure sensor, etc.) can be used to detect conditions of the environment (e.g., temperature, pressure, etc.) about the housing and/or the enclosure. For example, a temperature sensor can be used to detect temperatures exceeding a predetermined maximum temperature. In one embodiment, the control unit can then power off the sources to prevent further generation of the fluorescent light.

A power supply component can power the ultraviolet light emitting source(s), the visible light emitting source(s), the control unit, the user input component and the sensors. The power supply component can include one of a number of different power sources. In one embodiment, the power supply component can include a rechargeable battery that can be recharged from an external port and/or using a wireless charging solution. For example, a USB, mini USB or other appropriate port can be used to charge the battery.

A first aspect of the invention provides a wearable article of adornment, comprising: a housing having an inner wall surface and an outer wall surface; at least one ultraviolet light emitting source placed in the housing; a fluorescent material placed in the housing, the fluorescent material configured to generate fluorescent light in response to excitation with ultraviolet radiation emitted from the at least one ultraviolet light emitting source; a light transmitting material forming the outer wall surface of the housing, the light transmitting material configured to transmit the fluorescent light generated from the fluorescent material while absorbing the ultraviolet radiation; a control unit configured to control irradiation of the fluorescent material with the at least one ultraviolet light emitting source; and a power supply component configured to power the at least one ultraviolet light emitting source and the control unit.

A second aspect of the invention provides a wearable article of adornment, comprising: a housing; at least one ultraviolet light emitting source placed in the housing; an enclosure to enclose the housing, the enclosure having an inner wall surface and an outer wall surface, the inner wall surface including fluorescent material configured to generate fluorescent light in response to excitation with ultraviolet radiation emitted from the at least one ultraviolet light emitting source, and the outer wall surface including a window having a light transmitting material that transmits the fluorescent light while absorbing the ultraviolet radiation; a control unit configured to control irradiation of the fluorescent material with the at least one ultraviolet light emitting source; a user input component operatively coupled to the control unit that allows a user to activate and inactivate operation of the at least one ultraviolet light emitting source, wherein activation of the at least one ultraviolet light emitting source includes selection of one of a plurality of operating modes, wherein each operating mode is configured to generate fluorescent light at a predetermined fluorescent wavelength, intensity, pattern and duration; and a power supply component configured to power the at least one ultraviolet light emitting source, the control unit and the user input component.

A third aspect of the invention provides a wearable article of adornment, comprising: a housing; at least one visible light emitting source placed in the housing to generate visible light; at least one ultraviolet light emitting source interspersed with the at least one visible light emitting source in the housing to generate ultraviolet radiation; an enclosure to enclose the housing, the enclosure having an inner wall surface and an outer wall surface, the inner wall surface including fluorescent material configured to generate fluorescent light in response to excitation with ultraviolet radiation emitted from the at least one ultraviolet light emitting source, and the outer wall surface including a light transmitting material that transmits the fluorescent light generated from the fluorescent material and the visible light generated from the at least one visible light emitting source while absorbing the ultraviolet radiation generated from the at least one ultraviolet radiation source; a control unit configured to control irradiation of the fluorescent material with the at least one ultraviolet light emitting source and the visible light generated from the at least one visible light emitting source; a user input component operatively coupled to the control unit that allows a user to activate and inactivate operation of the at least one ultraviolet light emitting source and the at least one visible light emitting source, wherein activation of the at least one ultraviolet light emitting source and the at least one visible light emitting source includes selection of one of a plurality of operating modes; and a power supply component configured to power the at least one ultraviolet light emitting source, the at least one visible light emitting source, the control unit and the user input component.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
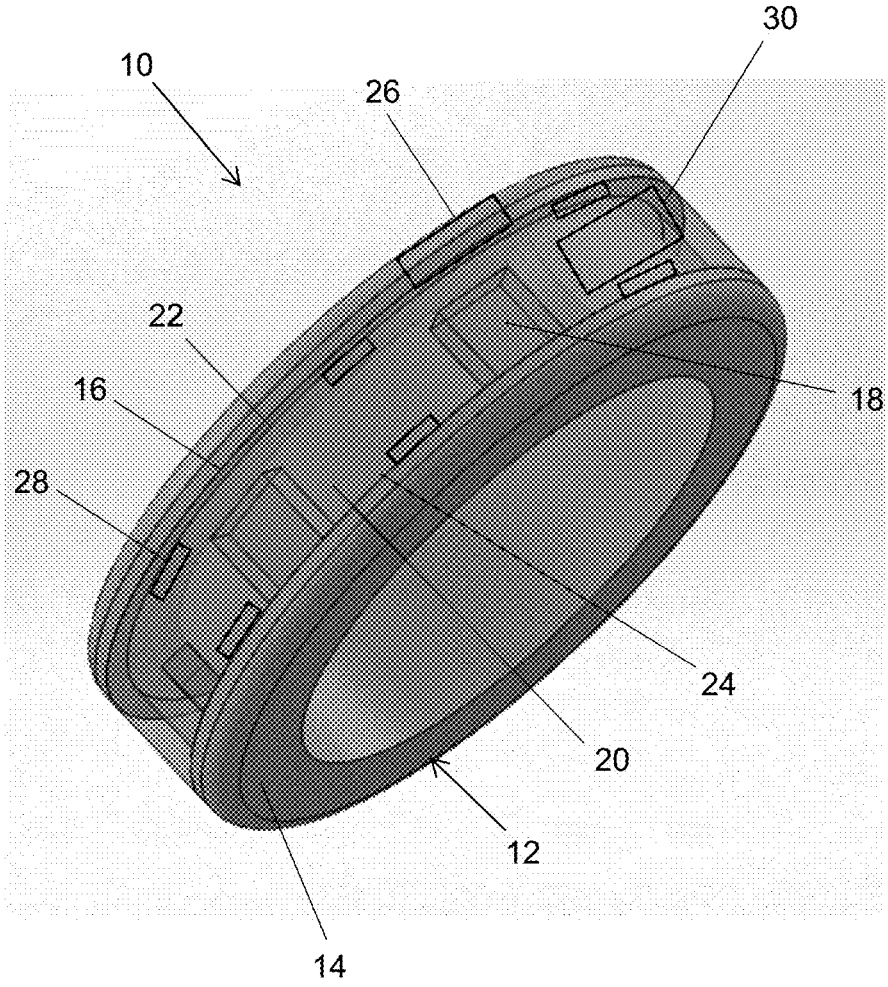
FIG. 1 shows a schematic of a wearable article of adornment in the form of a bracelet according to an embodiment.

As indicated above, aspects of the present invention are directed to light emitting adornments that utilize an ultraviolet light emitting source to irradiate fluorescent material in order to generate fluorescent light and can include a control unit to control the irradiation of the fluorescent material and the generation of the fluorescent light. This results in light emitting adornments with the capability to generate a multitude of different fluorescent light characteristics and color spectra that enhance, embellish or distinguish the wearer or object utilizing the adornments.

The light emitting adornments of the various embodiments are suitable for use with a wide variety of wearable articles of adornments. As used herein, a wearable article of adornment means any accessory or decoration that is worn, placed, arranged, disposed, etc., on a body of a wearer of the article or an object that utilizes the accessory or decoration. A non-exhaustive listing of wearable articles of adornment that can be worn, placed, arranged, disposed, on a body of a wearer comprise jewelry such as bracelets including ankle bracelets, bands, necklaces, earrings, watches, rings, lapel pins and pendants, body piercings, clothing accessories (e.g., hats, scarves, shoes), and hair accessories. A non-exhaustive listing of wearable articles of adornment that can be worn, placed, arranged, disposed, on an object are cell phone cases, toys, fish habitats, paperweights, and writing utensils. All of these examples are suitable for use with any of the embodiments described herein.

The various embodiments of wearable articles of adornment described herein can include a number of components (some of which may be optional) that facilitate the generation of fluorescent light. These components and the functions that each can perform are described below in more detail. The components can include any now known or later developed approaches that can facilitate implementation of the concepts and configurations of the various embodiments described herein.

Ultraviolet radiation, which can be used interchangeably with ultraviolet light, means electromagnetic radiation having a wavelength ranging from approximately 10 nm to approximately 400 nm. Within this range, there is ultraviolet-A (UV-A) electromagnetic radiation having a wavelength ranging from approximately 315 nm to approximately 400 nm, ultraviolet-B (UV-B) electromagnetic radiation having a wavelength ranging from approximately 280 nm to approximately 315 nm, and ultraviolet-C (UV-C) electromagnetic radiation having a wavelength ranging from approximately 100 nm to approximately 280 nm.

As used herein, a material/structure is considered to be "reflective" to ultraviolet light of a particular wavelength when the material/structure has an ultraviolet reflection coefficient of at least 30 percent for the ultraviolet light of the particular wavelength. A highly ultraviolet reflective material/structure has an ultraviolet reflection coefficient of at least 80 percent. Furthermore, a material/structure/layer is considered to be "transparent" to ultraviolet radiation of a particular wavelength when the material/structure/layer allows at least ten percent of radiation having a target wavelength, which is radiated at a normal incidence to an interface of the material/structure/layer to pass there through.

The description that follows may use other terminology herein for the purpose of only describing particular embodiments and is not intended to be limiting of the disclosure. For example, unless otherwise noted, the term "set" means one or more (i.e., at least one) and the phrase "any solution" means any now known or later developed solution. The singular forms "a," "an," and "the" include the plural forms as well, unless the context clearly indicates otherwise. It is further understood that the terms "comprises," "comprising," "includes," "including," "has," "have," and "having" when used in this specification, specify the presence of stated features, integers, steps, operations, elements, and/or components, but do not preclude the presence or addition of one or more other features, integers, steps, operations, elements, components, and/or groups thereof.

Turning to the drawings, FIG. 1 shows a schematic of a wearable article of adornment 10 in the form of a bracelet according to an embodiment. The wearable article of adornment 10 can include a housing 12 having an inner wall surface 14 and an outer wall surface 16. In one embodiment, the housing 12 can form the body of the wearable article, which in this example is a bracelet that can be worn on the wrist or ankle of a user. In this manner, the inner wall surface 14 of the housing 12 can face the wrist or ankle of a user when the article of adornment 10 is worn by the user, while the outer wall surface 16 is positioned outward to face away from the wrist or ankle.

At least one ultraviolet light emitting source 18 can be placed in the housing 12. In one embodiment, the ultraviolet light emitting source 18 can be placed in a location within the housing 12 that is between the inner wall surface 14 and the outer wall surface 16. As shown in FIG. 1, more than one ultraviolet light emitting source 18 can be placed in the housing 12. In this example in which the article of adornment 10 is a bracelet, a plurality of ultraviolet light emitting sources 18 can be circumferentially disposed about the housing 12. Although FIG. 1 shows that the ultraviolet light emitting sources 18 are uniformly spaced, it is understood that these sources can be disposed with non-uniform spacing. Furthermore, it is understood that the ultraviolet light emitting sources 18 do not necessarily need to be disposed circumferentially around the housing 12 and can be positioned in a variety of arrangements. Also, it is understood that the number of ultraviolet light emitting sources 18 that are used is variable and that any number of sources can be used.

An enclosure 20 having an inner wall surface 22 and an outer wall surface 24 can enclose the housing 12. The inner wall surface 22 of the enclosure 20 can include a coating, a film or a layer of fluorescent material that is configured to generate fluorescent light in response to excitation of the fluorescent material with ultraviolet radiation emitted from the ultraviolet light emitting source(s) 18. In one embodiment, a surface of the fluorescent material can be oriented perpendicular to a normal to the ultraviolet light emitting source(s) 18 in order to have the surface substantially illuminated by the source(s). The outer wall surface 24 of the enclosure 20 can include a window having a light transmitting material that transmits the fluorescent light while absorbing the ultraviolet radiation. In this example in which the article of adornment 10 is a bracelet, the enclosure 20 can enclose the housing in a circumferential manner. In one embodiment, the fluorescent material can be disposed circumferentially around all of the housing 12. However, it is understood that the fluorescent material does not necessarily need to be disposed circumferentially around all of the housing 12 and can be arranged in other configurations. For example, the fluorescent material can be arranged to optically align with the window in order to ensure that the fluorescent light is transmitted outside of the article of adornment 10, while sections of the enclosure 20 aligned with the ultraviolet light emitting source(s) 18 can have different ultraviolet radiation absorbing material to ensure that the area with the potential to have a greater amount of ultraviolet radiation does not permit penetration of the radiation though the outside of the adornment.

Although the housing 12 and the enclosure 20 are described in this embodiment as separate components of the wearable article of adornment 10, it is understood that other configurations are possible. For example, the housing 12 can be configured to perform the functions of both of these components. In particular, the housing 12 can be configured as a solitary, elliptical article hollowed out with a circumferential cavity to correspond with the shape of the article. In this manner, the ultraviolet light emitting source(s) 18 can placed about the cavity with the internal surface of an outer wall of the housing that surrounds the wrist, the ankle or the finger of the user wearing the article can contain the fluorescent material. The ultraviolet light emitting source(s) 18 can irradiate the fluorescent material, and the outer wall of the housing having a light transmitting material that absorbs ultraviolet radiation, can transmit the fluorescent light generated from the fluorescent material while absorbing the ultraviolet radiation.

The ultraviolet light emitting source(s) 18 depicted in FIG. 1 as well as the various other embodiments described herein can comprise any combination of one or more ultraviolet radiation emitters. Examples of an ultraviolet radiation emitter can include, but are not limited to, high intensity ultraviolet lamps (e.g., high intensity mercury lamps), discharge lamps, ultraviolet LEDs, super luminescent LEDs, laser diodes, and/or the like. In one embodiment, the ultraviolet light emitting sources 18 can include a set of LEDs manufactured with one or more layers of materials selected from the group-III nitride material system (e.g., $Al_xIn_yGa_{1-x-y}N$, where $0 \leq x$, $y \leq 1$, and $x+y \leq 1$ and/or alloys thereof). Additionally, the ultraviolet light emitting source(s) can comprise one or more additional components (e.g., a wave guiding structure, a component for relocating and/or redirecting ultraviolet radiation emitter(s), etc.) to direct and/or deliver the emitted radiation to a particular location/area, in a particular direction, in a particular pattern, and/or the like. Illustrative wave guiding structures can include, but are not limited to, a wave guide, a plurality of ultraviolet fibers, each of which terminates at an opening, a diffuser, and/or the like.

In order to generate fluorescent light with desirable fluorescent light characteristics that enhance, embellish or distinguish the wearer or the object that utilizes the wearable article of adornment 10, the ultraviolet light emitting sources 18 can be configured to operate at a wavelength that ranges from about 250 nm to about 460 nm. In one embodiment, the ultraviolet light emitting sources 18 can be configured to operate at distinct peak wavelengths. As used herein, distinct peak wavelengths are characterized by having a peak wavelength that is at least 10 nm apart, with a Full Width at Half Maximum (FWHM) being approximately 10 nm or less.

Figure 8:
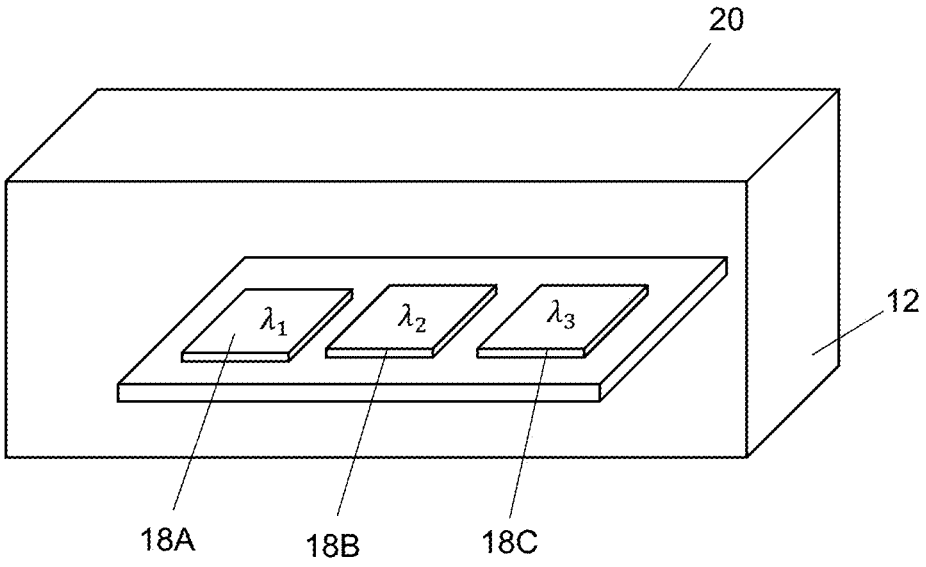
FIG. 8 shows a schematic of a configuration of a set of ultraviolet light emitting sources operating at different wavelengths configured to irradiate fluorescent material enclosed by ultraviolet absorbing material that is transparent to generate visible light that is suitable for use in a wearable article of adornment according to an embodiment.

In one embodiment, the set of ultraviolet light emitting sources 18 can be configured to operate at at least two different peak wavelengths ($\lambda$) within this 250 nm to 460 nm range. For example, one group of the ultraviolet light emitting sources 18 can operate at a peak wavelength of $\lambda_1$, a second group can operate at a peak wavelength of $\lambda_2$, and a third group can operate at a peak wavelength of $\lambda_3$. FIG. 8 shows a schematic of a configuration of a set of ultraviolet light emitting sources 18A, 18B, 18C operating at different wavelengths (e.g., $\lambda_1$, $\lambda_2$, $\lambda_3$) that are configured to irradiate fluorescent material in a housing 12 enclosed by an enclosure 20 to generate visible light that is suitable for use in a wearable article of adornment according to an embodiment. It is understood that the number of groups of ultraviolet light emitting sources operating at different peak wavelengths is variable and thus this embodiment is not meant to be limited to any particular number of sources.

Returning to FIG. 1, in one embodiment, the operation of ultraviolet light emitting sources 18 can be configured to function in a pulsed mode of operation. For example, one group of the ultraviolet light emitting sources 18 can generate radiation at a first wavelength, intensity and duration, while a second group of sources can generate radiation at a second wavelength, intensity and duration, while a third group of sources can generate radiation at a third wavelength, intensity and duration. The fluorescent material will be excited by the irradiation from each group such that there will be a generation of fluorescent light with different fluorescent characteristics (e.g., fluorescent wavelength, fluorescent intensity, fluorescent pattern and fluorescent duration) that varies according to the radiation characteristics of the group of sources irradiating the fluorescent material. It is understood that in the pulsed mode of operation, the ultraviolet light emitting sources can be pulsed to create illumination patterns that are time dependent.

In one embodiment, one or more optical elements can be used to optically couple the ultraviolet radiation onto the surface of the fluorescent material. In one embodiment, the optical element(s) can be placed in proximity to the ultraviolet light emitting source(s) 18. For example, the optical element(s) can be placed in the housing 12 or about the inner wall surface 22 of the enclosure 20. The optical element(s) can include, but are not limited to, one or more a parabolic mirror, a mirror, a prism, a lens, and/or combinations thereof.

In one embodiment, ultraviolet reflective surfaces can be used to recycle the ultraviolet radiation. For example, the inner wall surfaces of the housing 12 or the enclosure 20 can include an ultraviolet reflective material. In one embodiment, all or at least portion of the inner wall surfaces can have an ultraviolet reflective layer. In general, an ultraviolet reflective layer with a reflection coefficient of at least 50% will enable recycling of the ultraviolet radiation generation from the ultraviolet light emitting sources. In one embodiment, the ultraviolet reflective layer can include polished aluminum, PTFE (e.g., Teflon®), expanding polytetrafluoroethylene (ePTFE), ETFE or combinations thereof. In another embodiment, the ultraviolet reflective layer can include a diffusive ultraviolet reflective layer. The diffusive ultraviolet reflective layer can include a coating or thin film of a fluoropolymer. Examples of a fluoropolymer that are suitable as an ultraviolet reflective material that enables diffusive reflectivity can include, but are not limited to, expanding polytetrafluoroethylene (ePTFE) membrane (e.g., GORE® DRP® Diffuse Reflector Material), polytetrafluoroethylene (PTFE), and/or the like.

The fluorescent material used in the housing 12 or the enclosure 20 of this embodiment as well as any of the various embodiments can include a variety of materials that can generate fluorescent light in response to excitation by the ultraviolet light emitting source(s) 18. In one embodiment, the fluorescent material can comprise phosphors that fluoresce in different colors. Other fluorescent materials can include, but are not limited to, fluorescent dye. In one embodiment, a fluorescent material that fluoresces at several wavelengths of ultraviolet excitation, such as composite phosphorous material, can be used.

The fluorescent material can also comprise a liquid having a plurality of fluorescent domains floating in the liquid. In one embodiment, the fluorescent domains can comprise nanomaterials such as nanodots, wherein the size of the nanodots can be varied to provide desired color characteristics to the generated fluorescent light. In particular, nanodots can alter the absorption and emission spectra of materials due to changes in electron energy levels of nanodots as known in art. In one embodiment, a plurality of ultraviolet scattering domains can also be added to float in the liquid in order to scatter the fluorescent light generated from the fluorescent domains, aiding in obtaining fluorescent light characteristics of a desired effect. Examples of ultraviolet scattering domains can include, but are not limited to, $SiO_2$, $Al_2O_3$, $CaF_2$, aluminum and fluoropolymer domains, as well as water droplets and air cavities.

In one embodiment, the fluorescent material can comprise a composite material, wherein at least part of the composite material can fluoresce upon excitation with ultraviolet radiation. Examples of a composite material that can include a portion of fluorescent material that fluoresces under excitation of ultraviolet radiation includes, but is not limited to, composite phosphor powders. In one embodiment, the composite material can include a mix of different fluorescent materials each configured to generate fluorescent light at different fluorescent wavelengths. For example, a composite material can include a mix of phosphors and fluorescent dyes. In an embodiment, the phosphor can comprise europium SiAlON phosphor, aluminum doped zinc sulfide, and/or the like. Other phosphors can comprise rare-earth-doped phosphors, Tb3+, Ce3+:$LaPO_4$ for green and blue emission and Eu:$Y_2O_3$ for red emission.

The light transmitting material that absorbs ultraviolet radiation and transmits fluorescent light that can be used with the outer wall surface 16 of the housing 12, the outer wall surface 24 of the enclosure 20, or with a window formed on one of these outer surfaces can include any one of a number of different materials. Examples of a light transmitting material that absorbs ultraviolet radiation and transmits fluorescent light that can be used in the embodiment depicted in FIG. 1 and the other embodiments described herein can include, but are not limited to, transparent glass, a transparent polymer, and transparent liquids such as alcohols.

The wearable article of adornment 10 as well as the adornments of the other embodiments described herein can include other radiation sources beside the light emitting source(s). For example, at least one visible light emitting source can be used to enhance the fluorescent light generated from the excitation of the fluorescent material by the ultraviolet radiation from the ultraviolet light emitting source(s) 18. To this extent, the visible light from the visible light emitting sources can complement or enhance the generated fluorescent light to create a more specialized embellishment effect. For example, the visible light emitting sources can generate different colors of light (e.g., dark blue, blue, red, green, etc.) to complement the fluorescent light generated from the fluorescent material. Examples of visible light emitting sources that can be used include, but are not limited to, visible light emitting diodes, incandescent, fluorescent, laser, solid state light sources, and/or the like, that emit radiation having a wavelength at least partially in a range of 400 nm to 700 nm.

In one embodiment, a set of visible light emitting sources can be used in conjunction with the ultraviolet light emitting sources 18. The set of visible light emitting sources can be positioned in the housing between the inner and outer wall surfaces 14,16 or in the cavity formed between the housing 12 and the enclosure 20. The visible light emitting sources can be positioned adjacent to the ultraviolet light emitting sources 18. The number and the type of visible light that is generated from these visible light emitting sources, as well as their lighting characteristics (e.g., color, wavelengths, intensity, duration, etc.) can be varied in a number of ways to obtain a desired lighting effect. It is understood that the visible light emitting sources and the ultraviolet light emitting sources 18 can be configured to function in other coordinated manners where the wavelengths, intensities and durations of the sources are varied as desired.

A control unit can control (e.g., specify, modify, adjust) all of the radiation sources used with the wearable articles of adornment described herein. For example, FIG. 1 shows a control unit 26 that can be operatively coupled to the set of ultraviolet light emitting sources 18. The control unit 26 can control the fluorescent characteristics of the generated fluorescent light such as the fluorescent wavelength, the fluorescent intensity, fluorescent pattern and the duration as a function of the ultraviolet radiation generated from the ultraviolet light emitting source(s) that irradiates the fluorescent material. In one embodiment, the control unit 26 can specify various operating parameters for the ultraviolet light emitting source(s) 18 that influence the fluorescent light. The operating parameters can include, but are not limited to, an illumination time that ultraviolet radiation is directed towards the fluorescent material, a dosage of ultraviolet radiation delivered by the ultraviolet light emitting source(s) 18, a power setting for operating the ultraviolet light emitting source(s), and a maximum operating temperature. It is understood that these operating parameters are illustrative of some of the parameters that can be set by the control unit 26 and is not meant to be limiting as other parameters exist which may be specified such as a wavelength, intensity and duration of the ultraviolet light. The control unit 26 can also use these operating parameters to control the ultraviolet light emitting sources 18 and the fluorescent light generated from the fluorescent material to operate in a pulsed manner to generate varying pulses of fluorescent light with the option to have the pulses of fluorescent light differ by wavelength, intensity, pattern, and duration.

At least one sensor 28 can be configured to monitor the operation of the article of adornment 10. For example, at least one sensor 28 can monitor one of the operating parameters of the ultraviolet light emitting sources 18 during the illumination time, and at least one sensor can monitor the fluorescent characteristics of the generated fluorescent light. Signals of the conditions that the sensor(s) 28 are configured to monitor are used by the control unit 26 to control the operation of the sources and the fluorescent light including the fluorescent characteristics of the light. In the embodiment depicted in FIG. 1, the wearable article of adornment 10 can have sensors 28 located about the ultraviolet light emitting sources 18 and the fluorescent material. For example, sensors 28 can be located at various positions along the inner and outer wall surfaces 14,16 of the housing. If the article of adornment 10 utilizes both the housing 12 and the enclosure 20, then the sensors 28 can be placed along the surfaces of these components or in the cavity formed therebetween. It is understood that the location of the sensors 28 as well the number of sensors utilized are variable.

The types of sensors 28 in the article of adornment of FIG. 1 as well as the other embodiments described herein can include a number of different types of sensors. Examples of sensors that can be used include, but are not limited to, radiation sensors (e.g., an ultraviolet dose counter or meter) including fluorescence sensors, and visible light sensors (e.g., visible cameras); temperature sensors (e.g., thermistors); pressure sensors, and chemical sensors. In one embodiment, a plurality of radiation sensors can be used to detect radiation measurements about the housing 12 and/or the enclosure 20. Some of these radiation sensors can be used to measure the ultraviolet radiation characteristics of the ultraviolet radiation that irradiates the fluorescent material, while at least one of these sensors can include a fluorescent radiation sensor to measure the fluorescent radiation characteristics of the fluorescent light.

In one embodiment, a plurality of environmental condition sensors (e.g., temperature sensors, pressure sensors, etc.) can be used to detect conditions of the environment (e.g., temperature, pressure, etc.) about the housing 12 and/or the enclosure 20. For example, a temperature sensor can be used to detect whether temperatures in the housing exceed a predetermined maximum temperature. In one embodiment, the control unit 26 can power off the sources in response to detecting exceedingly high temperatures to prevent further generation of the fluorescent light until temperatures in the housing 12 including the enclosure 20 are within a sufficient temperature range.

The control unit 26 can include a timer (e.g., a dosage timer) with switches and/or the like, to manage the operation of the radiation sources including the ultraviolet light emitting sources 18 and the visible light emitting sources and the sensors 28. This allows the control unit 26 to control the duration that the sources are activated and ensure that desired fluorescent light characteristics are attained for that duration by adjusting or modifying any of the aforementioned operating parameters as necessary. For example, the control unit 26 operating in conjunction with the timer can manage the amount of time that the ultraviolet light emitting sources 18 radiate in a pulsed mode of operation, or mange which sources operate at common or different peak wavelengths. The operation of the ultraviolet light emitting sources will depend on detected condition signals provided to the control unit 26 by the sensors 28 as well as the type of fluorescent light characteristics that are desired.

The control unit 26 can also include a wireless transmitter and receiver that is configured to communicate with a remote location via Wi-Fi, BLUETOOTH, and/or the like. In this manner, a user can control the operation of the article of adornment with a smart phone. As used herein, a remote location is a location that is apart from the article of adornment. For example, a remote computer can be used to transmit operational instructions to the wireless transmitter and receiver. The operational instructions can be used to program functions performed and managed by the control unit 26. In another embodiment, the wireless transmitter and receiver can transmit output results, data from the sensors 28 to the remote computer to attain an analysis of the operation article of adornment 10 with regard to usage, fluorescent light effects that were generated, quality of the results, and maintenance items that are necessary or impending.

The control unit can include or operate in conjunction with other components to facilitate the generation of the fluorescent light in the wearable articles of adornment 10 as well as the adornments of the other embodiments described herein. For example, a user input component and an output component can allow a user to interact with the wearable article of manufacture 10. For example, a user input component can enable a user with the capability to activate and inactivate operation of the radiation sources including the ultraviolet light emitting source(s) and the visible light emitting source(s). In this manner, the user can select an operating mode from one of a variety of different modes in order to have the article of adornment 10 generate fluorescent light at a predetermined or desired fluorescent wavelength, intensity, pattern and duration.

In one embodiment, the user input component can permit a user to override the operation in one of these set modes, allowing the user the ability to adjust at least one of the aforementioned plurality of operating parameters as they want in order to get more of a "designer effect" showcasing the individuality of the user. In one embodiment, the user input component can include a set of switches (e.g., on/off switches), a set of buttons, and/or a touch screen with user-defined selections to enable a user to specify various input selections regarding the operating parameters as well as the desired fluorescent light characteristics. In one embodiment, a button or a set of buttons can be used to toggle through a multitude of operating modes for selection of one of the modes. For example, a user can select a particular mode of operation by following a proper sequence of buttons and durations of pressure signals for these buttons.

In one embodiment, the output component can include a visual display for providing status information on the operation of the article of adornment 10. For example, the output component can include an illuminating light display that is visible when the article of adornment is operating or is not illuminated light when the article is off.

For clarity, neither the user input component and the output component are depicted in FIG. 1 nor any of the other embodiments described herein, however, it is understood that these components are presumed to be incorporated with the control unit 26. Nevertheless, those skilled in the art will appreciate that the user input component and the output component can be implemented as separate components apart from the control unit 26. To this extent, the user input component and the output component can be deployed on the exterior of the housing 10 or the enclosure 20 to allow a user ease of access and operation with these components.

The article of adornment 10 can further include a power supply component 30 that is configured to power the ultraviolet light emitting source(s) 18, the visible light emitting source(s), the control unit 26 and the sensor(s) 28. The power supply component 30 can include any one of a number of different power sources. In one embodiment, the power supply component 30 can include a rechargeable battery that can be recharged from an external port and/or using a wireless solution. For example, a USB, mini USB or other appropriate port can be used to charge the battery. Other examples of power sources that can be used as the power supply component 30 can include, but are not limited to, one or more batteries, a vibration power generator that can generate power based on magnetic inducted oscillations or stresses developed on a piezoelectric crystal, and a super capacitor that is rechargeable. The power supply component 30 can be located in any of a number of different locations. For example, the power supply component 30 can be located within the body of the adornment 10 such as in the housing 12 or the enclosure 20, or on the exterior of any of these elements.

Figure 9:
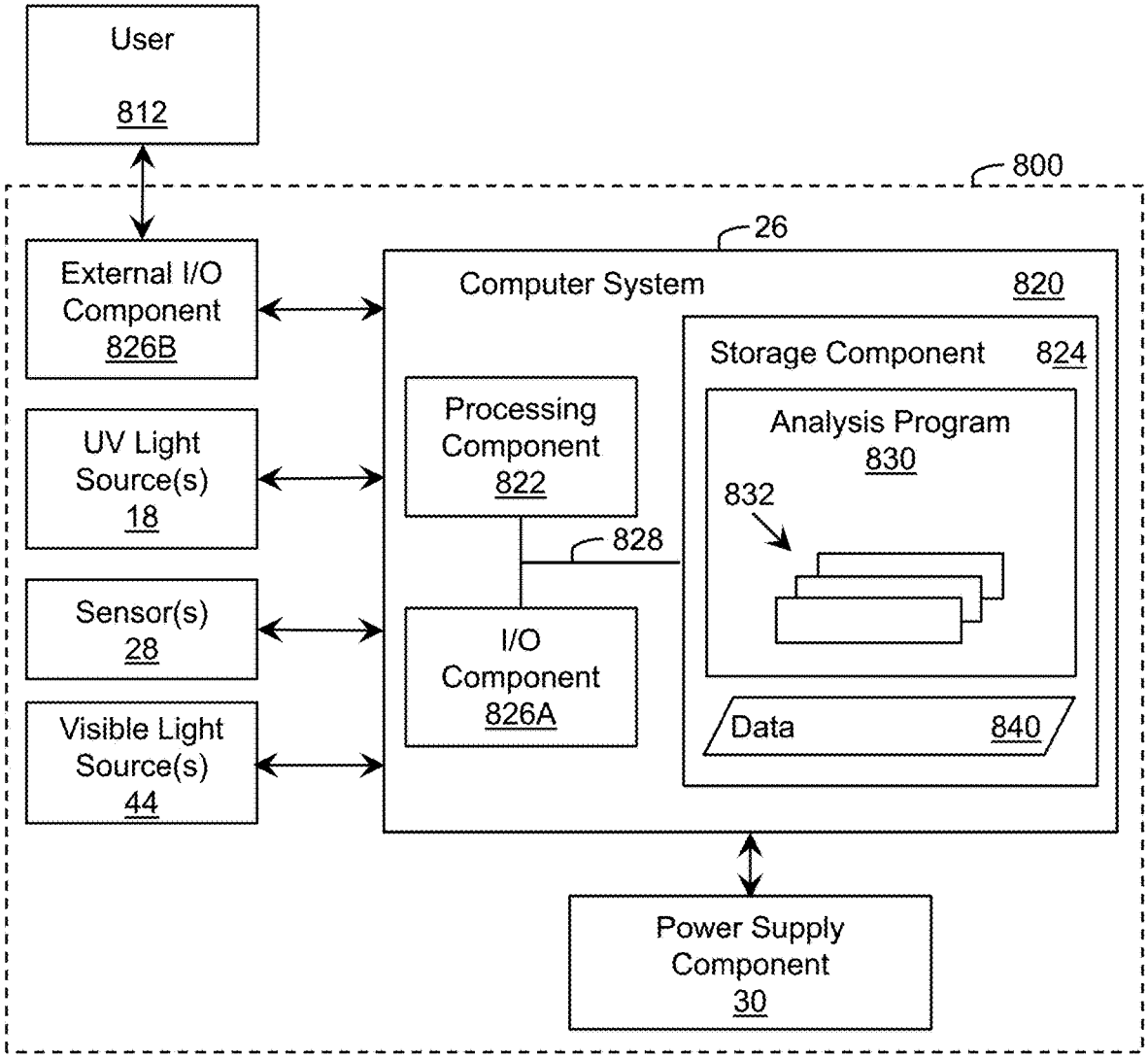
FIG. 9 shows a schematic block diagram representative of an overall processing architecture for generating fluorescent light in a wearable article of adornment according to an embodiment.

The aforementioned components of the article of adornment 10 are illustrated in FIG. 9 and discussed further with regard to that figure. These components are also suitable for use with the other embodiments described herein with respect to FIGS. 2-8. It is understood that the functions of these components can vary and will depend on the type of wearable article of adornment that these components are utilized with and the fluorescent light characteristics that a user desires to attain with the adornment. Thus, the functions described are only illustrative of examples of particular functions and operations to be performed and are not meant to be limiting to the embodiment of FIG. 1 as well as to any of the other embodiments described with respect to the other figures.

Figure 2:
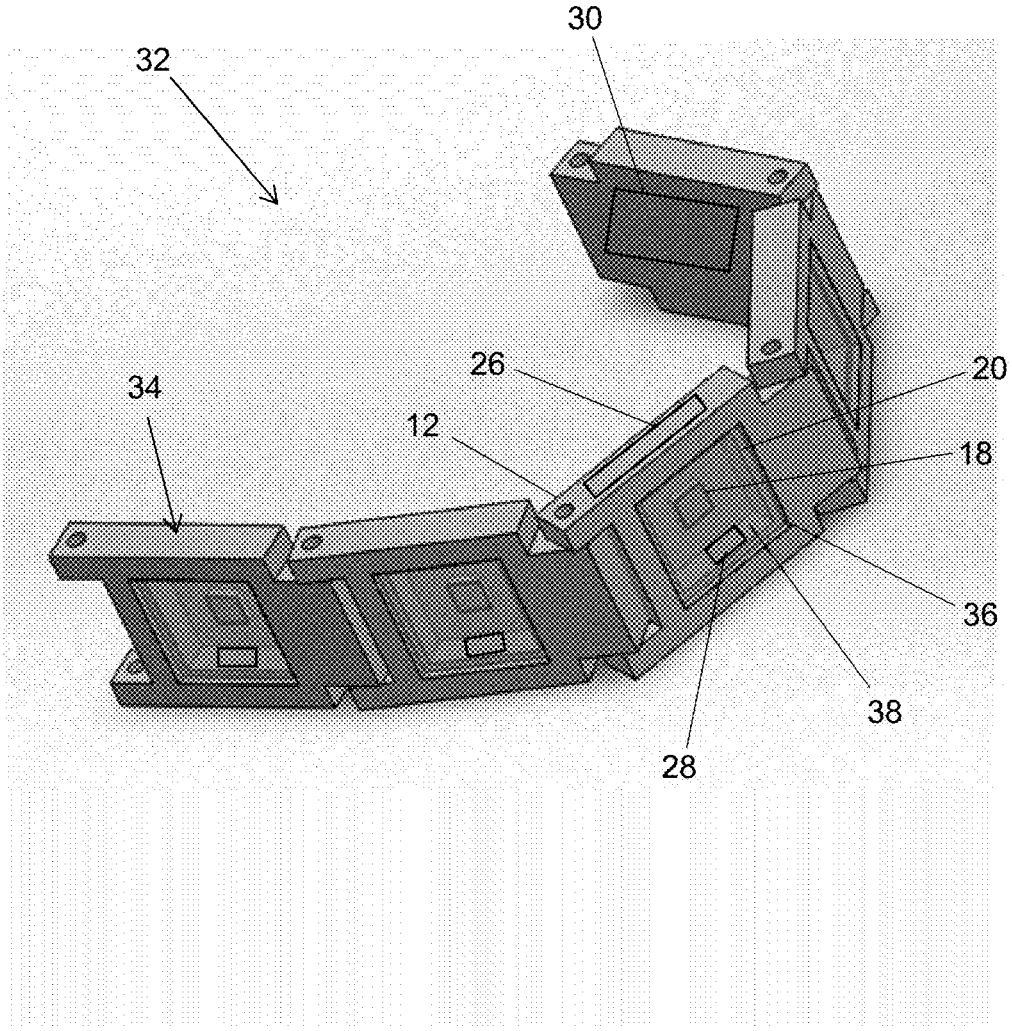
FIG. 2 shows a schematic of a wearable article of adornment in the form of another type of bracelet according to an embodiment.

FIG. 2 shows a schematic of a wearable article of adornment 32 in the form of another type of bracelet that can be worn about the wrist of a user according to an embodiment. Although the article of adornment 32 of FIG. 2 is described as a bracelet, it is understood that the features of this embodiment are applicable to any type of band having a substrate that can utilize rotatable joints, expandable elastic material, sections of flexible regions, or the like that can be fitted and worn around the wrist, arm, ankle and leg of a user. A watch band is one example of another type of a wearable article of adornment which can incorporate the features associated the embodiment described with respect to FIG. 2.

As shown in FIG. 2, the article of adornment 32 can be segmented into individual sections 34, with each section containing a housing 12, an enclosure 20 having a window 36 with fluorescent material 38 that covers the housing, at least one ultraviolet emitting light source 18 and at least one sensor 28 placed between the housing and the enclosure, a control unit 26 to control irradiation of the fluorescent material with the ultraviolet light emitting source(s), and a power supply component 30 to power the source(s) 18, the control unit 26 and the sensor(s) 28. Although the window 36 is described with the fluorescent material 38, it is understood that the fluorescent material can be positioned between the window and the ultraviolet light emitting source(s) 18. Also, it is understood that each individual section 34 of the article of adornment 32 can include at least one visible light emitting source to generate fluorescent light that supplements the light generated from the fluorescent material 38 that is transmitted out through the window 36. Both the fluorescent light generated from the fluorescent material 38 and the visible light generated from any visible light emitting source(s) could be transmitted through the window 36, while the light transmitting and ultraviolet radiation absorbing material of the window would absorb the ultraviolet radiation, preventing it from escaping outside the exterior of the adornment 32.

Further, although the control unit 26 is depicted in FIG. 2 in one of the individual sections 34 of the article of adornment 32, it is understood that the sections can be electrically wired to form a distributed system of sections that can be controlled by the control unit 26. Instead of electrically wiring the sections 34 to the control unit 26, this distributed system of connected sections can be implemented through the use of well-known wireless communication technologies. Also, the power supply component 30 can be connected to each individual section 34 including its respective sources and sensors, and the control unit 26 through a wired or wireless connection. Although the sections 34 of the article of adornment 32 can be controlled and powered by a centralized control unit 26 and a power supply component 30, it is understood that these individual sections can be implemented with their own respective control unit and power supply.

The control unit 26 can control the generation of fluorescent light from each individual section 34 caused by the excitation of the fluorescent material 38 with the ultraviolet light emitting source(s) 18 and/or the use of visible light emitting source(s). In this manner, each of the sections 34 can be controlled independently of the other sections in order to generate fluorescent light from the article of adornment 32 with fluorescent characteristics (e.g., fluorescent wavelength, intensity, pattern, and/or duration) that can vary or conform from one section 34 to another section. The control unit 26 can control the type of fluorescent light generated from the sections 34 by specifying and adjusting any of the aforementioned parameters and/or characteristics to obtain a desired fluorescent light effect. For example, the control unit 26 can activate and control the ultraviolet light emitting sources 18 of the sections 34 to operate in a pulsed mode with each pulse and interval between pulses having a predetermined duration, or one that has been specified through the use of the user input component. It is understood that the control unit 26 can be used to select only a few of the individual sections 34 that actually operate in this pulsed mode of operation while having the other the sections configured to function in another mode with different fluorescent light characteristics being generated.

Figure 3:
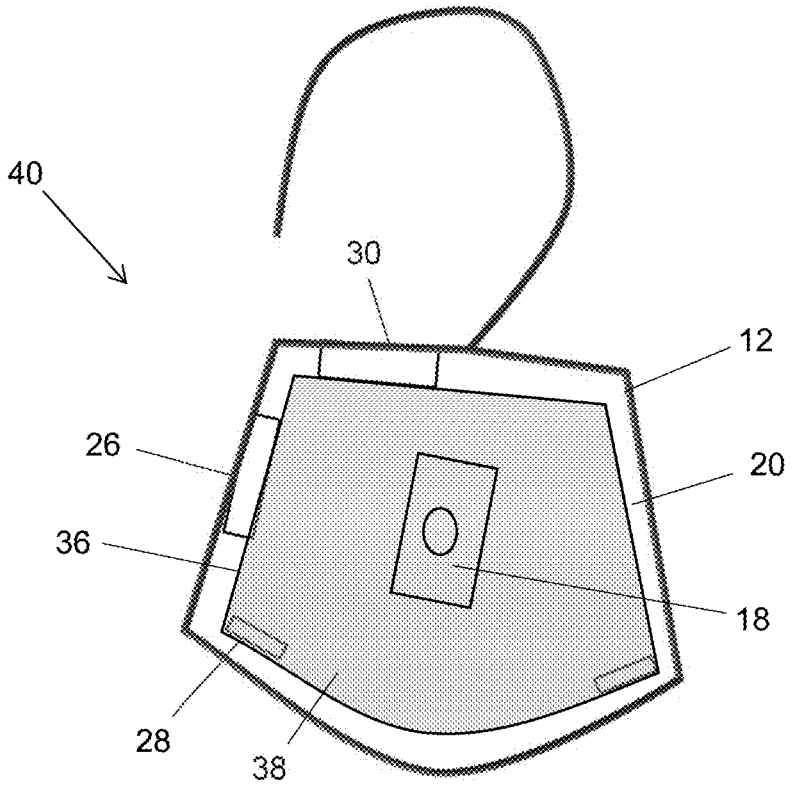
FIG. 3 shows a schematic of a wearable article of adornment in the form of an earring according to an embodiment.
Figure 4:
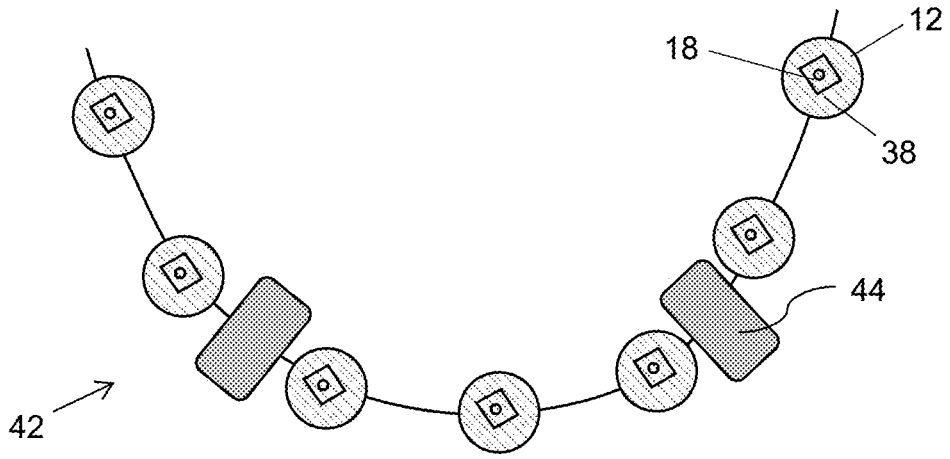
FIG. 4 shows a schematic of a wearable article of adornment in the form of a necklace according to an embodiment.

The housing and enclosure configurations discussed with regard to FIGS. 1-2 have applicability with other jewelry type adornments beyond bracelets and bands. For example, FIG. 3 shows a schematic of a wearable article of adornment 40 in the form of an earring according to an embodiment, while FIG. 4 shows a schematic of a wearable article of adornment 42 in the form of a necklace according to an embodiment. Both of these adornments can utilize any of the aforementioned configurations associated with the housing 12, the enclosure 20 including windows 36, the ultraviolet light emitting source(s) 18, the control unit 26 and the sensor(s) 28. Note that the article of adornment 42 of FIG. 4 is shown with at least one visible light emitting source 44 that can be used to generate visible light that complements the fluorescent light generated from the excitation of the fluorescent material 38 with ultraviolet radiation by the ultraviolet light emitting source(s) 18. All of these components in the adornments of both FIGS. 3 and 4 can operate pursuant to any of the aforementioned modes of operation to generate fluorescent light with desired fluorescent light characteristics that satisfies a specified selection entered by a user or wearer of the adornments 40 and 42.

It is understood that for clarity in illustrating the various embodiments with respect to different types of adornments, not all of the previously mentioned components can be depicted in the figures. For example, the details of the wall surfaces of the housing 12 and the enclosure 20, the control unit 26, the sensors 28 and the power supply component 30 may have been omitted. Nevertheless, it is understood that the articles of adornments 40 and 42 of FIGS. 3 and 4, respectively, can have these components.

Figure 5:
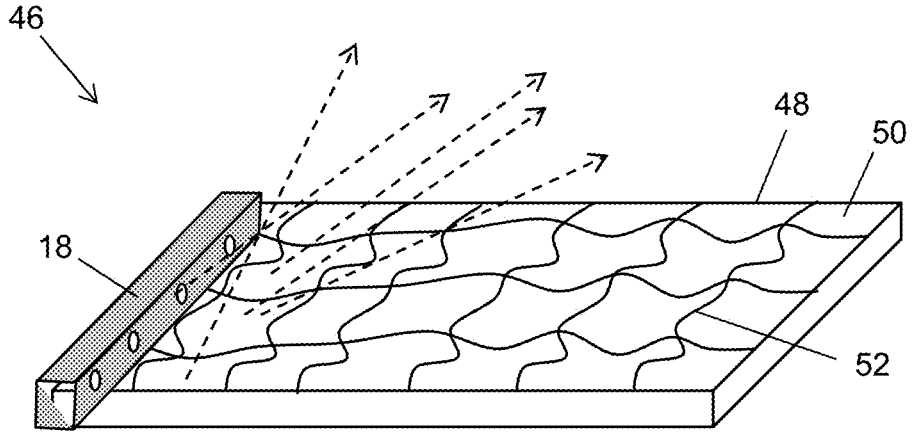
FIG. 5 shows a schematic of a light emitting configuration of a set of ultraviolet light emitting sources operatively coupled to an ultraviolet transparent material with light guiding media having fluorescent material embedded therein that is suitable for use in a wearable article of adornment according to an embodiment.

FIG. 5 shows a schematic of a light emitting configuration 46 of a set of ultraviolet light emitting sources 18 operatively coupled to an ultraviolet transparent material with light guiding media 48 having fluorescent material embedded in the media that is suitable for use in a wearable article of adornment according to an embodiment. As shown in FIG. 5, the set of ultraviolet light emitting sources 18 can be oriented perpendicular to a normal to a top surface 50 of the ultraviolet transparent material with light guiding media 48. In this manner, the ultraviolet radiation emanating from the set of ultraviolet light emitting sources 18 is directed over the top surface 50 of the ultraviolet transparent material with light guiding media 48. This allows the ultraviolet transparent material with light guiding media 48 to guide the ultraviolet radiation towards the fluorescent material embedded in the media. The embedded fluorescent material generates the fluorescent light in response to being excited by the ultraviolet radiation emanating from the set of ultraviolet of light emitting sources 18. Advantages to using an ultraviolet transparent material having light guiding media 48 with embedded fluorescent material with the set of ultraviolet light emitting sources 18 as depicted in FIG. 5 can include distribution of ultraviolet light to various fluorescent elements embedded within the light guiding media.

Although not depicted in FIG. 5, it is understood that the light emitting configuration 46 with the set of ultraviolet light emitting sources 18 and the ultraviolet transparent material with light guiding media 48 having embedded fluorescent material could be implemented in a housing or housing/enclosure configuration and used with a wearable article of adornment. Further, it is understood that the light emitting configuration 46 could be implemented with a control unit 26, at least one sensor 28, and a power supply component 30 to generate fluorescent light according to one of the aforementioned modes of operation or per the desired fluorescent characteristics specified by a user through a user input component. Also, it is understood that one or more visible light emitting sources can be implemented with the light emitting configuration 46 to complement the fluorescent light generated from the ultraviolet transparent material with light guiding media 48.

The ultraviolet transparent material with light guiding media 48 and embedded fluorescent material can be selected from a number of different materials. For example, the ultraviolet transparent material and light guiding media 48 with embedded fluorescent material can include a composite material where at least part of the composite material can fluoresce. In one embodiment, the composite material can include a mix of different fluorescent materials each configured to generate fluorescent light at different fluorescent wavelengths. In one embodiment, the ultraviolet transparent material with light guiding media 48 can include, but is not limited to, $SiO_2$, $CaF_2$, $MgF_3$, $Al_2O_3$, fluoropolymer such as Teflon®, EFET, EFEP, and/or the like with fluorescent material embedded therein. Any of the aforementioned fluorescent materials would be suitable for being embedded in these materials. In one embodiment, the fluorescent material embedded in the ultraviolet transparent material with light guiding media 48 can include a mixture of a multiple of different fluorescent materials that have been formulated to provide a desired fluorescent emission.

The ultraviolet transparent material and light guiding media 48 with embedded fluorescent material can be configured with one of a number of components that enable the light emitting configuration 46 to generate interesting illuminating effects. For example, as shown in FIG. 5, the top surface 50 of the ultraviolet transparent material with light guiding media 48 can be formed with rough elements 52 for scattering the emitted fluorescent light. In one embodiment, the rough elements 52 can be embedded with the fluorescent material to create fluorescent diffusive emittance of the fluorescent light. In another embodiment, the ultraviolet transparent material with light guiding media 48 can include internal cavities filled with air or water to create special illuminating effects. With any of these embodiments, the ultraviolet transparent material having light guiding media 48 with embedded fluorescent material can have an index of refraction that is at least 10% higher than the index of refraction at an interface with an outer wall surface in which the media is situated in use with an article of adornment. Having an index of refraction that is at least 10% higher than the index of refraction at the interface is beneficial with regard to generating fluorescent light in that the light guiding media will be able to effectively guide ultraviolet radiation due to some total internal reflection at the interface of the high and low refractive index media.

Figure 6A:
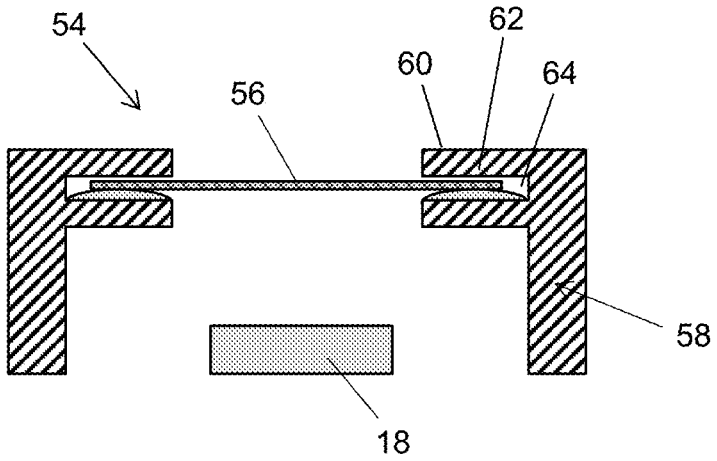
FIGS. 6A-6B show a schematic of a light emitting configuration of an ultraviolet light emitting source configured to irradiate a removeable film of fluorescent material secured by a fluorescent film holder that is suitable for use in a wearable article of adornment according to an embodiment.
Figure 6B:
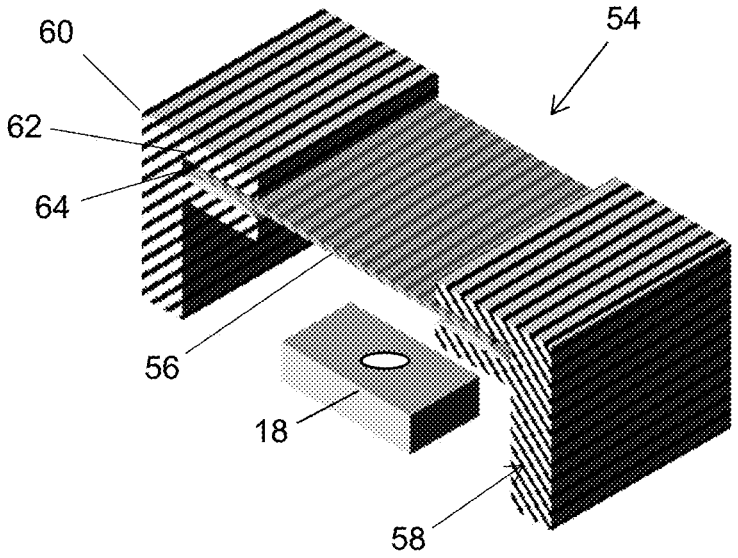

FIGS. 6A-6B show a schematic of a light emitting configuration 54 of an ultraviolet light emitting source 18 configured to irradiate a removeable film of fluorescent material 56 secured by a fluorescent film holder 58 that is suitable for use in a wearable article of adornment according to an embodiment. In particular, FIG. 6A shows a cross-sectional view of the light emitting configuration 54, while FIG. 6B shows a perspective view of the configuration. In one embodiment, the fluorescent film holder 58 can be formed as a part of the body of the article of adornment, or as a specific part of a housing for the light emitting configuration 54. In one embodiment, the fluorescent film holder 58 and the fluorescent material 56 can be formed as part of both a housing and enclosure implementation. For example, the film holder 58 can form a part of both the housing and the enclosure, while the removeable film of fluorescent material 56 can form another part of the enclosure. In one embodiment, the film holder 58 and the film of fluorescent material 56 can form a removeable or replaceable part that can be attached to or removed from the article of adornment as a unit.

As shown in FIGS. 6A-6B, the fluorescent film holder 58 can include a pair of post-like structures 60 spaced at a predetermined distance apart from one another, with each having a pair of retaining prongs 62 with a slit 64 formed therebetween. In this manner, the film of fluorescent material 56 can be securely held in place in the fluorescent film holder 58 at a predetermined distance from the ultraviolet light emitting source 18. In addition, the film of fluorescent material 56 can be removed from the fluorescent film holder 58. In particular, the film of fluorescent material 56 can be slid in and out from the slits 64 of the fluorescent film holder 58. It is understood that the film holder 58 depicted in FIGS. 6A-6B represents only one possible configuration that can be deployed to enable the use of a replaceable or removeable film of fluorescent material. Those skilled in the art will appreciate that other fastener approaches can be utilized.

Examples can include, but are not limited to, mechanical fasteners, clips, tabs, magnetic couplers, etc.

Although not depicted in FIGS. 6A-6B, it is understood that the light emitting configuration 54 with an ultraviolet light emitting source 18 configured to irradiate a removeable film of fluorescent material 56 secured by a fluorescent film holder 58 could be implemented with any of the aforementioned components. For example, the light emitting configuration 54 could be implemented with a control unit 26, at least one sensor 28, and a power supply component 30 to generate fluorescent light according to one of the aforementioned modes of operation or per the desired fluorescent characteristics specified by a user through a user input component. Also, it is understood that one or more visible light emitting sources can implemented with the light emitting configuration 54 to complement the fluorescent light generated from the removeable film of fluorescent material 56.

The use of the light emitting configuration 54 with the removeable film of fluorescent material 56 can facilitate a multitude of different illuminating effects with varying fluorescent light characteristics. For example, a multiple of different fluorescent films that each generate a distinct set of fluorescent light characteristics (e.g., different fluorescent light wavelengths, intensities, patterns, and/or duration) can be easily inserted for use with the article of adornment and removed therefrom when the use of another fluorescent film with different characteristics is desired. In addition, the films can be easily replaced if damaged.

Figure 7:
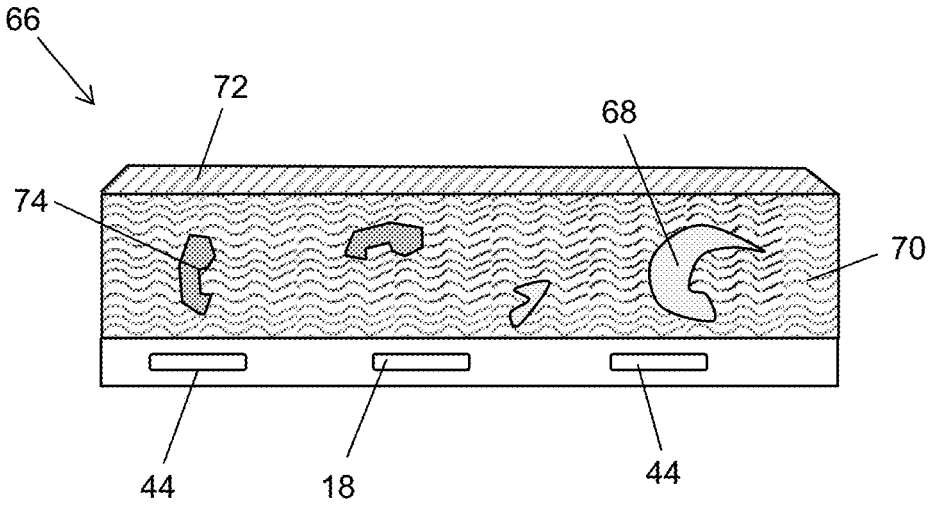
FIG. 7 shows a schematic of a light emitting configuration of ultraviolet light emitting sources and visible light emitting sources configured to irradiate domains of fluorescent material floating in a liquid enclosed by ultraviolet absorbing material transparent to visible light that is suitable for use in a wearable article of adornment according to an embodiment.

FIG. 7 shows a schematic of a light emitting configuration 66 of ultraviolet light emitting sources 18 and visible light emitting sources 44 configured to irradiate domains of fluorescent material 68 floating in a liquid 70 enclosed by ultraviolet absorbing material 72 transparent to visible light that is suitable for use in a wearable article of adornment according to an embodiment. In one embodiment, in which a housing and enclosure arrangement is utilized as previously described, the sources 18 and 44 can be positioned in the housing while the liquid 70 and floating domains of fluorescent material 68 can be located in the cavity formed between the housing and the enclosure, and the ultraviolet absorbing material 72 can form the outer walled surface of the enclosure.

With this configuration, the ultraviolet light emitting sources 18 can direct ultraviolet radiation to the liquid 70. The domains of fluorescent material 68 generate fluorescent light in response to being excited by the ultraviolet radiation. The fluorescent light generated from the domains of fluorescent material 68 passes through the ultraviolet absorbing material 72 along with the visible light generated from the visible light emitting sources 44, while ultraviolet radiation generated from the ultraviolet light emitting sources 18 is absorbed by the material 72. The ultraviolet absorbing material 72 transparent to visible light can include any of the aforementioned materials described with respect to other embodiments such as, but not including, a transparent polymer or glass. With this configuration, any of the previously mentioned fluorescent light characteristics can be generated along with different lighting effects (e.g., emitting different color lights). An article of adornment that incorporates such a configuration provides a user or wearer of the article with the capability to have a multitude of number of lighting effect options. The use of the liquid 70 and the domains of fluorescent material 68 have the effect of guiding ultraviolet radiation towards the fluorescent domains. In addition, the floating fluorescent domains can enable the color motion within an adornment.

As used herein, the domains of fluorescent material 68 mean a material that can generate visible fluorescent radiation due to absorption of the excitation radiation.

In an embodiment, the excitation can comprise UV-C, UV-B, UV-A, near UV, blue, and/or the like, radiation. The domains of fluorescent material 68 can include any of the aforementioned fluorescent materials. In one embodiment, the fluorescent domains can comprise nanomaterials such as nanodots. In one embodiment, the size of the nanodots can be varied to provide specific color characteristics to the generated fluorescent light. For example, nanodots of 1-2 nanometers generally will generate blue fluorescent colors, while nanodots of about >6 nm will generate red colors. The domains of fluorescent material 68 can be shaped to have a number of different forms which serve to scatter fluorescent light and may affect perception of color and shape. The number of domains of fluorescent material 68 floating in the liquid 70 and the size of the domains can be variable and their selection will generally depend on the type of lighting effect that is desired. A variety of different liquids can be utilized for the liquid 70 in the light emitting configuration 66 of FIG. 7. In one embodiment, the liquid 70 can include water.

In one embodiment, a plurality of ultraviolet scattering domains 74 can also be added to float in the liquid 70 along with the domains of fluorescent material 68 in order to scatter the fluorescent light generated from the fluorescent domains and the visible light emitting sources 44. The use of the ultraviolet scattering domains 74 aids in obtaining light characteristics of varying effect. Any of the aforementioned examples of ultraviolet scattering domains are also suitable for this embodiment.

Although not depicted in FIG. 7, it is understood that the light emitting configuration 66 with the ultraviolet light emitting sources 18 and visible light emitting sources 44 configured to irradiate domains of fluorescent material 68 floating in the liquid 70 could be implemented with any of the aforementioned components. For example, the light emitting configuration 66 could be implemented with a control unit 26, at least one sensor 28, and a power supply component 30. To this extent, the control unit 26, the sensor(s) 28, and the power supply component 30 enable a user with the capability to generate fluorescent light according to one of the aforementioned modes of operation or to generate light with "designed" fluorescent characteristics specified by a user through a user input component.

Referring now to FIG. 9, there is a schematic block diagram representative of an overall processing architecture of a system 800 for generating fluorescent light in a wearable article of adornment. In this embodiment, the architecture 800 is shown including the radiation sources (e.g., ultraviolet light emitting source(s) and visible light emitting source(s)) 18, 44 and the sensor(s) 28 for the purposes of illustrating the interaction of all of the components that can be used in a wearable article of manufacture that generates fluorescent light.

As depicted in FIG. 9 and described herein, the system 800 can include a control unit 26. In one embodiment, the control unit 26 can be implemented in the form of a control unit embodying a computer system 820 including an analysis program 830, which makes the computer system 820 operable to manage the radiation sources 18, 44 and the sensors 28 in the manner described herein. In particular, the analysis program 830 can enable the computer system 820 to operate the radiation sources 18, 44 and process data obtained during operation which is stored as data 840. The computer system 820 can individually control each source 18, 44 and sensor 28 and/or control two or more of the sources and the sensors as a group. Furthermore, the radiation sources can emit radiation of substantially the same wavelength or of multiple distinct wavelengths, or in a pulsed mode of operation.

In an embodiment, during an initial period of operation, the computer system 820 can acquire data from at least one of the sensors 28 regarding one or more attributes and generate data 840 for further processing. The computer system 820 can use the data 840 to control one or more aspects of the radiation generated by the radiation sources 18, 44.

Furthermore, one or more aspects of the operation of the radiation sources 18, 44 can be controlled or adjusted by a user 812 via an external interface I/O component 826B. The external interface I/O component 826B can be used to allow the user 812 to for example, selectively turn on/off the radiation sources 18, 44 and select the generation of certain fluorescent characteristics.

The external interface I/O component 826B can include, for example, a touch screen that can selectively display user interface controls, such as control dials, which can enable the user 812 to adjust one or more of: an intensity, and/or other operational properties of the set of radiation sources 18, 44 (e.g., operating parameters, radiation characteristics). In an embodiment, the external interface I/O component 826B could include a keyboard, a plurality of buttons, a joystick-like control mechanism, and/or the like, which can enable the user 812 to control one or more aspects of the operation of the set of radiation sources 18, 44. The external interface I/O component 826B also can include any combination of various output devices (e.g., an LED, a speaker, a visual display), which can be operated by the computer system 820 to provide status information for use by the user 812. For example, the external interface I/O component 826B can include one or more LEDs for emitting a visual light for the user 812, e.g., to indicate a status of the irradiation of the samples. In an embodiment, the external interface I/O component 826B can include a speaker for providing an alarm (e.g., an auditory signal), e.g., for signaling that ultraviolet radiation is being generated or that an irradiation has finished.

The computer system 820 is shown including a processing component 822 (e.g., one or more processors), a storage component 824 (e.g., a storage hierarchy), an input/output (I/O) component 826A (e.g., one or more I/O interfaces and/or devices), and a communications pathway 828. In general, the processing component 822 executes program code, such as the analysis program 830, which is at least partially fixed in the storage component 824. While executing program code, the processing component 822 can process data, which can result in reading and/or writing transformed data from/to the storage component 824 and/or the I/O component 826A for further processing. The pathway 828 provides a communications link between each of the components in the computer system 820. The I/O component 826A and/or the external interface I/O component 826B can comprise one or more human I/O devices, which enable a human user 812 to interact with the computer system 820 and/or one or more communications devices to enable a system user 812 to communicate with the computer system 820 using any type of communications link. To this extent, during execution by the computer system 820, the analysis program 830 can manage a set of interfaces (e.g., graphical user interface(s), application program interface, and/or the like) that enable human and/or system users 812 to interact with the analysis program 830. Furthermore, the analysis program 830 can manage (e.g., store, retrieve, create, manipulate, organize, present, etc.) the data, such as data 840, using any solution.

In any event, the computer system 820 can comprise one or more general purpose computing articles of manufacture (e.g., computing devices) capable of executing program code, such as the analysis program 830, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, the analysis program 830 can be embodied as any combination of system software and/or application software.

Furthermore, the analysis program 830 can be implemented using a set of modules 832. In this case, a module 832 can enable the computer system 820 to perform a set of tasks used by the analysis program 830, and can be separately developed and/or implemented apart from other portions of the analysis program 830. When the computer system 820 comprises multiple computing devices, each computing device can have only a portion of the analysis program 830 fixed thereon (e.g., one or more modules 832). However, it is understood that the computer system 820 and the analysis program 830 are only representative of various possible equivalent monitoring and/or control systems that may perform a process described herein with regard to the control unit, the sources and the sensors. To this extent, in other embodiments, the functionality provided by the computer system 820 and the analysis program 830 can be at least partially be implemented by one or more computing devices that include any combination of general and/or specific purpose hardware with or without program code. In each embodiment, the hardware and program code, if included, can be created using standard engineering and programming techniques, respectively. Illustrative aspects of the invention are further described in conjunction with the computer system 820. However, it is understood that the functionality described in conjunction therewith can be implemented by any type of monitoring and/or control system.

Regardless, when the computer system 820 includes multiple computing devices, the computing devices can communicate over any type of communications link. Furthermore, while performing a process described herein, the computer system 820 can communicate with one or more other computer systems, such as the user 812, using any type of communications link. In either case, the communications link can comprise any combination of various types of wired and/or wireless links; comprise any combination of one or more types of networks; and/or utilize any combination of various types of transmission techniques and protocols.

All of the components depicted in FIG. 9 can receive power from a power supply component 30. The power supply component 30 can take the form of one or more batteries, a vibration power generator that can generate power based on magnetic inducted oscillations or stresses developed on a piezoelectric crystal, a wall plug for accessing electrical power supplied from a grid, and/or the like. In an embodiment, the power supply source can include a super capacitor that is rechargeable. Other power supply components that are suitable for use as the power supply component can include solar, a mechanical energy to electrical energy converter such as a piezoelectric crystal, a rechargeable device, etc.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A wearable article of adornment, comprising:

a housing having an inner wall surface and an outer wall surface;

at least one ultraviolet light emitting source placed in the housing;

a fluorescent material placed in the housing, the fluorescent material configured to generate fluorescent light in response to excitation with ultraviolet radiation emitted from the at least one ultraviolet light emitting source, wherein fluorescent light characteristics of the fluorescent light are influenced by the ultraviolet radiation emitted from the at least one ultraviolet light emitting source;

a light transmitting material forming the outer wall surface of the housing, the light transmitting material configured to transmit the fluorescent light generated from the fluorescent material while absorbing the ultraviolet radiation;

a control unit configured to control irradiation of the fluorescent material with the at least one ultraviolet light emitting source to generate fluorescent light with desired fluorescent light characteristics and color spectra, wherein the control unit is configured to specify one or more of a plurality of operating parameters of the at least one ultraviolet light emitting source to generate the fluorescent light with the desired fluorescent light characteristics and color spectra, and wherein the control unit is configured to modify the specified one or more operating parameters of the at least one ultraviolet light emitting source during the irradiation of the fluorescent material as necessary to ensure that the desired fluorescent light characteristics and color spectra are attained; and a power supply component configured to power the at least one ultraviolet light emitting source and the control unit.

2. The wearable article of adornment of claim 1, wherein the at least one ultraviolet light emitting source comprises a plurality of ultraviolet light emitting sources, the plurality of ultraviolet light emitting sources operating at at least two different peak wavelengths, each different peak wavelength selected from a range of 250 nm to 460 nm.

3. The wearable article of adornment of claim 1, further comprising a user input component operatively coupled to the control unit that allows a user to activate and inactivate operation of the at least one ultraviolet light emitting source, wherein activation of the at least one ultraviolet light emitting source includes selection of one of a plurality of operating modes, wherein each operating mode is configured to generate fluorescent light at a predetermined fluorescent wavelength, intensity, pattern, and duration.

4. The wearable article of adornment of claim 1, wherein the inner wall surface of the housing comprises an ultraviolet transparent material with light guiding media to guide the emitted ultraviolet radiation towards the fluorescent material, wherein the fluorescent material is embedded with the light guiding media.

5. The wearable article of adornment of claim 4, wherein the ultraviolet transparent material with light guiding media comprises an index of refraction that is at least 10% higher than the index of refraction at an interface with the outer wall surface of the housing.

6. The wearable article of adornment of claim 1, wherein the fluorescent material comprises a composite material, wherein at least part of the composite material can fluoresce.

7. The wearable article of adornment of claim 6, wherein the composite material comprises a mix of different fluorescent materials each configured to generate fluorescent light at different fluorescent wavelengths.

8. The wearable article of adornment of claim 1, wherein the fluorescent material comprises internal cavities filled with air or water.

9. The wearable article of adornment of claim 1, wherein the fluorescent material comprises a fluorescent film that is removable from the housing.

10. The wearable article of adornment of claim 1, wherein the inner wall surface of the housing comprises a liquid, wherein the fluorescent material comprises a plurality of fluorescent domains floating in the liquid.

11. A wearable article of adornment, comprising:

a housing;

at least one ultraviolet light emitting source placed in the housing;

an enclosure to enclose the housing, the enclosure having an inner wall surface and an outer wall surface, the inner wall surface including ultraviolet transparent material with light guiding media and fluorescent material embedded in the light guiding media, wherein the ultraviolet transparent material is configured to receive ultraviolet radiation emitted from the at least one ultraviolet light emitting source, the light guiding media guiding the ultraviolet radiation towards the fluorescent material, the fluorescent material generating fluorescent light in response to excitation with the ultraviolet radiation, and the outer wall surface including a window having a light transmitting material that transmits the fluorescent light while absorbing the ultraviolet radiation;

a control unit configured to control irradiation of the fluorescent material with the at least one ultraviolet light emitting source;

a user input component operatively coupled to the control unit that allows a user to activate and inactivate operation of the at least one ultraviolet light emitting source, wherein activation of the at least one ultraviolet light emitting source includes selection of one of a plurality of operating modes, wherein each operating mode is configured to generate fluorescent light at a predetermined fluorescent wavelength, intensity, pattern, and duration; and a power supply component configured to power the at least one ultraviolet light emitting source, the control unit and the user input component.

12. The wearable article of adornment of claim 11, wherein the housing and the enclosure are segmented into corresponding sections, wherein each segmented housing section includes an ultraviolet light emitting source with a corresponding enclosure section to enclose the housing section, each enclosure section having an inner wall surface including ultraviolet transparent material with light guiding media and fluorescent material embedded in the light guiding media, and an outer wall surface including a light transmitting material to transmit fluorescent light outside the enclosure section while absorbing ultraviolet radiation, wherein the control unit is configured to manage the fluorescent light emitted from each segmented housing section and corresponding segmented enclosure section.

13. The wearable article of adornment of claim 12, wherein the control unit is configured to control irradiation of the ultraviolet transparent material with light guiding media and fluorescent material in each segmented enclosure section by the ultraviolet light emitting source in the corresponding segmented housing section, wherein each segmented housing section and corresponding segmented enclosure section generates fluorescent light at a predetermined fluorescent wavelength, intensity, pattern, and duration.

14. The wearable article of adornment of claim 12, wherein each segmented housing section and corresponding segmented enclosure section operates independently from other segmented housing sections and corresponding segmented enclosure sections.

15. The wearable article of adornment of claim 14, wherein the control unit is configured to direct the fluorescent light emitted from each segmented housing section and corresponding segmented enclosure section in a pulsed mode, wherein the control unit controls a duration of the pulse, a time interval between each pulse, and selects which segmented housing section and corresponding segmented enclosure section operates in the pulsed mode.

16. The wearable article of adornment of claim 15, wherein all of the segmented housing sections and corresponding segmented enclosure sections form a distributed system of connected adornment elements.

17. A wearable article of adornment, comprising:

a housing;

at least one visible light emitting source placed in the housing to generate visible light;

at least one ultraviolet light emitting source interspersed with the at least one visible light emitting source in the housing to generate ultraviolet radiation;

an enclosure to enclose the housing, the enclosure having an inner wall surface and an outer wall surface, the inner wall surface including fluorescent material configured to generate fluorescent light in response to excitation with ultraviolet radiation emitted from the at least one ultraviolet light emitting source, and the outer wall surface including a light transmitting material that transmits the fluorescent light generated from the fluorescent material and the visible light generated from the at least one visible light emitting source while absorbing the ultraviolet radiation generated from the at least one ultraviolet radiation source;

a control unit configured to control irradiation of the fluorescent material with the at least one ultraviolet light emitting source and the visible light generated from the at least one visible light emitting source;

a user input component operatively coupled to the control unit that allows a user to activate and inactivate operation of the at least one ultraviolet light emitting source and the at least one visible light emitting source, wherein activation of the at least one ultraviolet light emitting source and the at least one visible light emitting source includes selection of one of a plurality of operating modes; and a power supply component configured to power the at least one ultraviolet light emitting source, the at least one visible light emitting source, the control unit and the user input component.

18. The wearable article of adornment of claim 17, further comprising a plurality of radiation sensors to detect radiation measurements about the housing and the enclosure.

19. The wearable article of adornment of claim 18, wherein the plurality of radiation sensors comprises at least one ultraviolet radiation sensor to measure ultraviolet radiation characteristics of the ultraviolet radiation that irradiates the fluorescent material and at least one fluorescent radiation sensor to measure fluorescent radiation characteristics of the generated fluorescent light.

20. The wearable article of adornment of claim 17, further comprising a plurality of environmental condition sensors that detect conditions of the environment about the housing and the enclosure during ultraviolet irradiation and fluorescent light generation.

* * * * *